US005967855A

United States Patent [19]

Asakura et al.

[11] Patent Number: 5,967,855

[45] Date of Patent: Oct. 19, 1999

[54] CONNECTION STRUCTURE FOR SHIELD ELECTRIC CABLE AND METHOD OF PROCESSING SHIELD ELECTRIC CABLE

[75] Inventors: Nobuyuki Asakura; Yasumichi Kuwayama; Tetsuro Ide, all of Shizuoka-ken, Japan

[73] Assignee: Yazaki Corporation, Tokyo, Japan

[21] Appl. No.: 09/153,154

[22] Filed: Sep. 15, 1998

[30] Foreign Application Priority Data

Sep. 16, 1997 [JP] Japan ..... 9-251087

[51] Int. Cl.[6] ..... H01R 9/05; H01R 17/04

[52] U.S. Cl. ..... 439/681; 439/99

[58] Field of Search ..... 439/581, 578, 439/98, 99, 874

[56] References Cited

U.S. PATENT DOCUMENTS

| | | | |
|---|---|---|---|
| 3,600,499 | 8/1971 | Hibbs | 174/70 S |
| 4,895,525 | 1/1990 | Leonardo | 439/99 |
| 4,964,814 | 10/1990 | Tengler et al. | 439/607 |
| 5,061,827 | 10/1991 | Grabbe | 174/756 |
| 5,478,258 | 12/1995 | Wang | 439/581 |
| 5,501,615 | 3/1996 | Inabe et al. | 439/578 |
| 5,580,276 | 12/1996 | Mussen | 439/581 |
| 5,603,635 | 2/1997 | Delamotte et al. | 439/581 |
| 5,735,695 | 4/1998 | Heinrich | 439/63 |

FOREIGN PATENT DOCUMENTS

| | | |
|---|---|---|
| 8-78071 | 3/1996 | Japan . |
| WO 97/04500 | 2/1997 | WIPO . |

*Primary Examiner*—Steven L. Stephan
*Assistant Examiner*—Chandrika Prasad
*Attorney, Agent, or Firm*—Finnegan, Henderson, Farabow, Garrett & Dunner, L.L.P.

[57] ABSTRACT

A connection structure for a shield electric cable and a method of processing a shield electric cable are intended for a shield electric cable having a cable core, an insulating inner jacket covering the cable core, a braided wire formed around the insulating inner jacket, and an insulating outer jacket formed around the braided wire so as to cover the cable core, the insulating inner jacket, and the braided wire. The connection structure includes an exposed portion of the braided wire obtained by partially exposing the braided wire and a shield terminal connected to the exposed portion. The shield electric cable and the shield terminal are connected to each other with a shield terminal joint portion formed between the shield terminal and the exposed portion by use of resistance welding. The method of processing a shield electric cable includes a step of bringing the shield terminal into contact with the exposed portion so as to resistance-weld the shield terminal to the exposed portion. With this resistance welding, the shield electric cable and the shield terminal are connected to each other.

7 Claims, 4 Drawing Sheets

CONNECTION STRUCTURE FOR SHIELD ELECTRIC CABLE AND METHOD OF PROCESSING SHIELD ELECTRIC CABLE

BACKGROUND OF THE INVENTION

1. Field of the Invention

The present invention relates to a connection structure for a shield electric cable and a method of processing a shield electric cable and, more particularly, to a connection structure for a shield electric cable for connecting a shield electric cable and a shield terminal and a method of processing a shield electric cable in this connection.

2. Description of the Related Art

As a conventional connection structure for a shield electric cable, the structure described in Japanese Patent Unexamined Laid-Open Publication No. 8-78071.

In this connection structure, a shield electric cable, which extends in an almost columnar shape and is obtained by sequentially stacking an insulating inner jacket, a braided wire, and an insulating outer jacket on the outer layer of an innermost cable core, is subjected to a so-called peeling process to perform connection.

More specifically, the insulating outer jacket is peeled to expose the braided wire inside the insulating outer jacket.

Next, the braided wire is folded on the insulating outer jacket to overlap. Thereafter, the insulating inner jacket inside the braided wire is peeled to expose the cable core existing in the innermost portion.

Next, the insulating inner jacket of the shield electric cable subjected to this process pierces a holding portion of a terminal which is independently prepared, and the holding portion is caulked to fix the terminal through the insulating inner jacket. At this time, when the holding portion is caulked, the cable core of the shield electric cable is connected to the terminal to render them conductive.

Next, a cylindrical shield terminal is independently prepared. The shield electric cable connected to the terminal are caused to pierce the shield terminal, and the shield terminal and the braided wire of the shield electric cable are connected to each other inside the shield terminal to render them conductive.

More specifically, connection between the shield terminal and the braided wire is performed by the following manner. That is, a bent leaf spring piece is arranged in the shield terminal, and the shield terminal and the braided wire are brought into contact with each other to sandwich the braided wire of the shield electric cable between the bent leaf spring pieces.

Certainly, in the above connection structure, the braided wire of the shield electric cable need not be exposed in a long range. For this reason, operations, i.e., an operation of twisting the braided wire or causing the braided wire to go through a thermal shrinkage tube, or an operation of caulking the shield terminal on the braided wire to connect them to each other, are not required. Therefore, the connection workability is improved.

However, in this connection structure, in order to connect the braided wire of the shield electric cable to the shield terminal, a leaf spring piece is additionally arranged inside the shield terminal, and the structure of the shield terminal is complicated. For this reason, the manufacture itself of the shield terminal is complicated.

In addition, in order to prevent contact between the leaf spring piece and the braided wire of the shield electric cable from being imperfect, the spring load of the leaf spring piece must be set to be large to some extent. However, the spring load is increased, the braided wire cannot be easily inserted to the bent portion of the leaf spring piece, the workability becomes defective. Further, depending on cases, the braided wire is pressed by the leaf spring piece in the direction opposing the insertion direction to set a state wherein the leaf spring piece is mainly in contact with only the insulating inner jacket as a result. That is, imperfect contact between the leaf spring piece and the braided wire may occur.

As a matter of course, in order to connect a shield electric cable and a shield terminal to each other, the insulating outer jacket of the shield electric cable must be peeled to expose the braided wire with a certain length over the entire circumference. The most of the peeling step cannot help depending on a manual operation, and a long period of time is required to correctly perform the operation. As a result, the operation is not efficient.

SUMMARY OF THE INVENTION

It is an object of the present invention to provide a connection structure for a shield electric cable and a method of processing a shield electric cable being capable of making the structure of a shield terminal connected to the shield electric cable simple, and being capable of connecting the shield electric cable to the shield terminal simply and reliably.

More specifically, a connection structure for a shield electric cable according to the present invention is intended for a shield electric cable having a cable core, an insulating inner jacket for covering the cable core, a braided wire formed around the insulating inner jacket, and an insulating outer jacket, formed around the braided wire, for covering the cable core, the insulating inner jacket, and the braided wire, and comprises an exposed portion of the braided wire obtained by partially exposing the braided wire on the insulating outer jacket of the shield electric cable, a shield terminal connected to the exposed portion at the exposed portion, and a shield terminal joint portion for connecting the shield terminal to the exposed portion at the exposed portion of the braided wire. Here, the shield terminal joint portion is formed by joining the shield terminal to the exposed portion with resistance welding, and the shield electric cable and the shield terminal are connected to each other with the shield terminal joint portion.

According to this connection structure of the present invention, one side of the shield terminal is joined to the exposed portion of the braided wire with resistance welding to form the shield terminal joint portion, thereby electrically connecting the shield terminal and the braided wire to each other.

This joint performed by the resistance welding is not mechanical contact which easily causes imperfect contact, but metal contact in which metals are melted to be joined to each other. As a result, high-reliable connection can be obtained.

And the shield terminal included in the present invention has a structure in which one side is joined to the exposed portion of the braided wire, and need not use a conventional leaf spring piece having a complex structure. That is, the shield terminal has a simple structure.

And further, only the insulating outer jacket of the shield electric cable regarding the present invention is partially removed. That is, conventional cumbersome operations such as an operation of peeling the insulating outer jacket of the shield electric cable to expose the entire braided wire, an operation of folding the braided wire of the shield electric cable and an operation of twisting the braided wire are not required, and the workability is improved.

Here, the shield terminal included in the present invention preferably has a joint portion to be joined to the exposed portion, a ground terminal portion to be grounded, and a step portion for connecting the joint portion and the ground terminal portion such that the ground terminal portion is located to be spaced apart from the shield electric cable in a state wherein the shield electric cable and the shield terminal are joined to each other.

In this connection structure of the present invention, at the shield terminal, since the step portion is formed such that the ground terminal portion is arranged at a position spaced apart from the shield electric cable, that is, apart from at least the insulating outer jacket of the outermost layer, the ground terminal portion is not in contact with the cable core or the like of the shield terminal not to be short-circuited. Therefore, this connection structure can be safely used.

In addition, a terminal metal fitting is connected to the cable core of the shield electric cable included in the present invention, and an end portion of the shield electric cable on the connection side to which the shield terminal and the terminal metal fitting are connected is accommodated in a connector housing.

In this connection structure, since the shield terminal connected to the braided wire of the shield electric cable is accommodated in the connector housing together with the terminal metal fitting connected to the cable core of the shield electric cable, the structure of the terminal portion of the shield electric cable is a simple structure.

In addition, the exposed portion of the braided wire of the shield electric cable regarding the present invention preferably has a shape having a longitudinal direction in the axial direction of the shield electric cable to improve the facility and reliability of resistance welding.

Besides, a method of processing a shield electric cable according to the present invention is intended for a shield electric cable having a cable core, an insulating inner jacket for covering the cable core, a braided wire formed around the insulating inner jacket, and an insulating outer jacket, formed around the braided wire, for covering the cable core, the insulating inner jacket, and the braided wire, and the method comprises the step of preparing a shield electric cable, the step of preparing a shield terminal, the step of partially removing the insulating outer jacket of the shield electric cable to partially expose the braided wire and to form an exposed portion, and the step of bringing the shield terminal into contact with the exposed portion to resistance-weld the shield terminal to the exposed portion. With this resistance welding, the shield electric cable and the shield terminal are connected to each other.

According to this processing method of the present invention, the insulating outer jacket of the shield electric cable is partially removed to expose the braided wire, and one side of the shield terminal is brought into contact with the exposed portion of the braided wire, so that one side of the shield terminal and the braided wire are resistance-welded to each other.

Therefore, since the contact portion between one side of the shield terminal and the braided wire is melted by the resistance welding, such one side of the shield terminal can be strongly and reliably connected to each other.

Here, the resistance welding is preferably performed by a parallel electrode scheme such that a pair of electrodes are brought into contact with the contact portion between the shield terminal and the exposed portion to supply power to the pair of electrodes.

In this manner, in the resistance welding performed by the parallel electrode scheme, since welding can be performed in a small space, welding to the shield electric cable can be easily and correctly performed.

In addition, the pair of electrodes are preferably arranged parallel to the axial direction of the shield electric cable to improve the facility and the reliability of the resistance welding.

DETAILED DESCRIPTION OF THE PREFERRED EMBODIMENT

An embodiment of the present invention will be described below with reference to the accompanying drawings.

Figure 1:
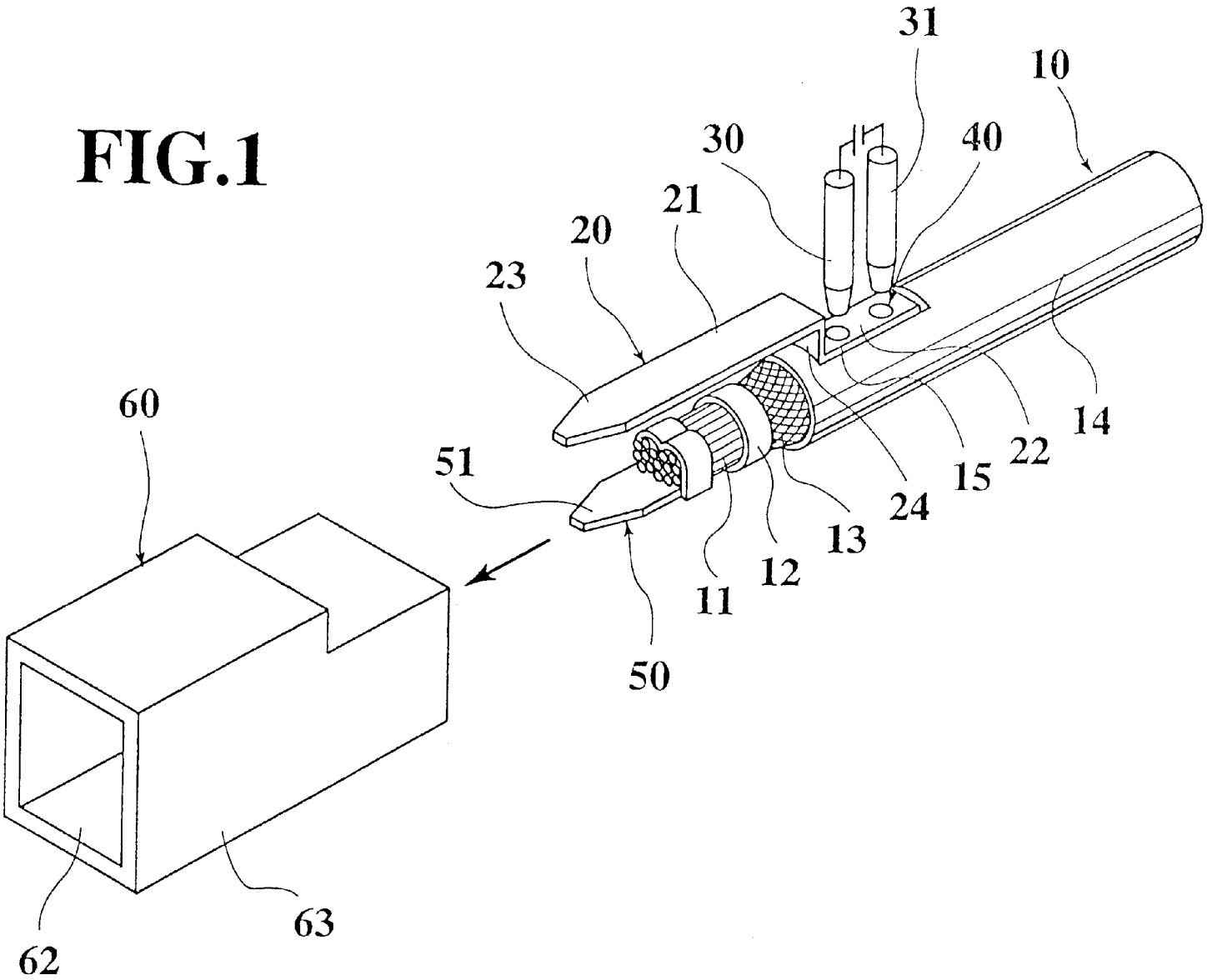
FIG. 1 is a perspective view mainly showing a state wherein a shield electric cable according to an embodiment of the present invention is connected to a shield terminal by resistance welding.
Figure 2:
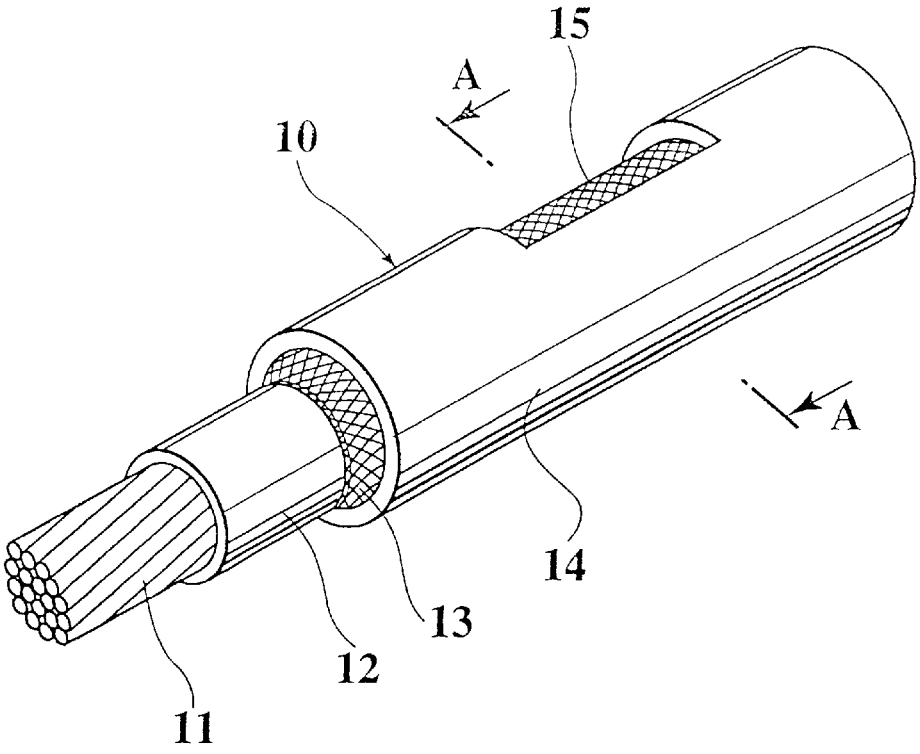
FIG. 2 is a perspective view showing the shield electric cable according to the embodiment of the present invention.
Figure 3:
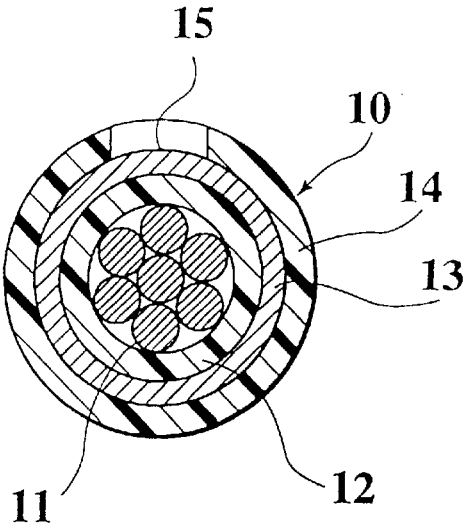
FIG. 3 is a sectional view showing the shield electric cable according to the embodiment of the present invention cutaway along an A—A line in FIG. 2.

As shown in FIGS. 1 to 3, a shield electric cable 10 used in this embodiment extends in a substantially columnar shape and has a basic arrangement in which, on its substantially circular section, a cable core 11 formed by an innermost conductor, an insulating inner jacket 12 for covering the cable core 11, a braided wire 13 formed by a conductor arranged around the insulating inner jacket 12, and an insulating outer resin jacket 14, arranged on the periphery of the braided wire 13 as an outermost layer, for covering the cable core 11, the insulating inner jacket 12, and the braided wire 13.

In the shield electric cable 10 having the above basic arrangement, according to this embodiment, the insulating outer jacket 14 is partially removed to form an exposed portion 15 obtained by partially exposing the braided wire 13.

The exposed portion 15 has a substantial rectangular shape having a longitudinal direction in the axial direction of the columnar shape of the shield electric cable 10. That is, the exposed portion 15 has a predetermined length in the axial direction of the columnar shape of the shield electric cable 10 to leave a remaining portion at an end portion on one side of the insulating outer jacket 14, and, in the circumference direction, a portion near the top of the insulating outer jacket 14 is cut off so as to form the rectangular shape.

At the end of the shield electric cable 10 on one side described above, the cable core 11 existing in the innermost portion is also exposed to project for a predetermined length in the axial direction.

In the drawings, the insulating inner jacket 12 and the braided wire 13 are exposed. However, such a state is not necessary on the function. It is satisfied that the insulating inner jacket 12 and the braided wire 13 are located at the same surface position as that of the insulating outer jacket 14.

On the other hand, a shield terminal 20 in this embodiment is having a plate-like terminal body 21 as a step-like member. More especially, a joint portion 22 is arranged on one side of the plate-like terminal body 21 and is joined to the exposed portion 15 of the shield electric cable 10, a ground terminal portion 23 is arranged on the other side of the plate-like terminal body 21, and a step portion 24 is arranged between the joint portion 22 and the ground terminal portion 23 to connect them to each other.

In this shield terminal 20, the joint portion 22 is connected to the exposed portion 15 of the shield electric cable 10. When the joint portion 22 is connected to the exposed portion 15 of the shield electric cable 10, the ground terminal portion 23 is arranged to be spaced apart from the insulating outer jacket 14 of the shield electric cable 10.

For this reason, the ground terminal portion 23 extends in the axial direction of the in the axial direction of the shield electric cable 10 so as to be spaced apart from the cable core 11 of the shield electric cable 10 to be prevented from being in contact with the cable core 11. As a result, the shield terminal 20 and the cable core 11 of the shield electric cable 10 are not short-circuited.

Here, electrodes 30 and 31 shown in FIG. 1 and connected through a predetermined power supply are used to connect the joint portion 22 of the shield terminal 20 and the exposed portion 15 of the shield electric cable 10 to each other. The joint portion 22 and the exposed portion 15 are strongly joined to each other by a shield terminal joint portion 40 by use of resistance welding using the electrodes 30 and 31.

And, a terminal metal fitting 50 is caulked on the cable core 11 of the shield electric cable 10.

In addition, the shield electric cable 10 to which the shield terminal 20 and the terminal metal fitting 50 are connected is accommodated in the connector housing 60 on the shield terminal 20 side and the terminal metal fitting 50 side.

A method of processing a shield electric cable according to this embodiment of the present invention will be described below.

The shield electric cable 10 having the above arrangement is prepared. The cable core 11 is exposed to project in the axial direction.

Next, the insulating outer jacket 14 of shield electric cable 10 is mechanically partially removed to form the exposed portion 15.

This removing operation is performed by the following manner. That is, as shown in FIGS. 1 to 3, the insulating outer jacket 14 of the shield electric cable 10 is removed so as to form a rectangular shape having a longitudinal direction in the axial direction of the columnar shape of the shield electric cable 10. This rectangular shape is formed so as to have a predetermined length such that a remaining portion is left at the end of the insulating outer jacket 14 on the side accommodated in the connector housing 60 in the axial direction of the columnar shape of the shield electric cable 10, and a portion of the insulating outer jacket 14 near its top portion in the circumference direction of the columnar shape of the shield electric cable 10 is cut off to form this rectangular shape.

Figure 4:
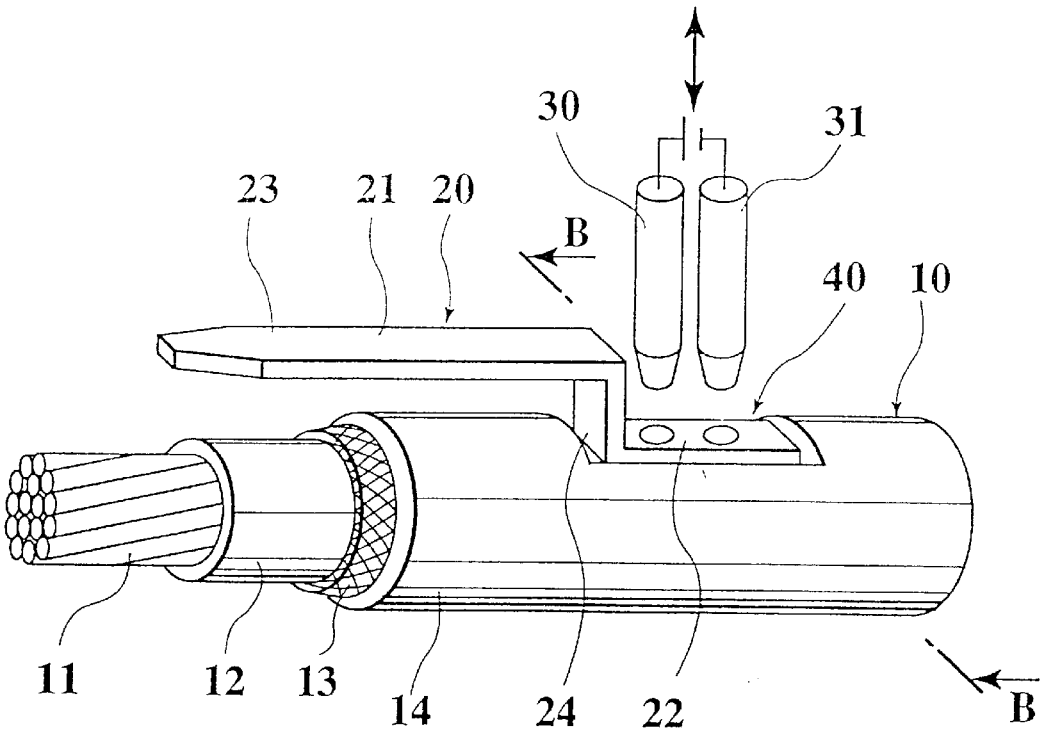
FIG. 4 is a perspective view showing a state wherein a joint portion of a shield terminal is resistance-welded on an exposed portion of a braided wire of the shield electric cable according to the embodiment of the present invention.
Figure 5:
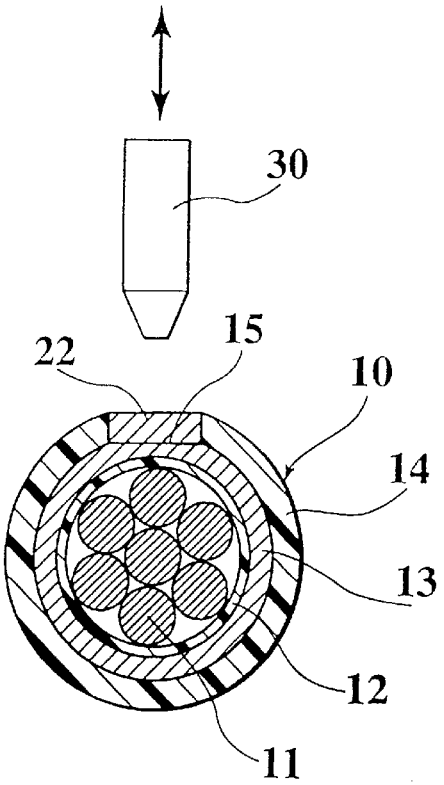
FIG. 5 is a sectional view showing the shield electric cable according to the embodiment of the present invention cutaway along a B—B line in FIG. 4.

As shown in FIGS. 4 and 5, the joint portion 22 of the shield terminal 20 is brought into contact with the exposed portion 15. In this state, the electrodes 30 and 31 are made close to and contact with the shield electric cable 10, and a current is caused to flow across the joint portion 22 and the exposed portion 15 to heat the joint portion 22 and the exposed portion 15. The joint portion 22 and the exposed portion 15 are applied with a pressure and are resistance-welded to strongly join them to each other.

The resistance welding used in this embodiment is performed by a so-called parallel electrode scheme.

In the resistance welding using the parallel electrode scheme, the distal ends of the two thin-needle-like electrodes 30 and 31 are brought into contact with the joint portion 22 of the shield terminal 20 while the arrangement direction of the electrodes 30 and 31 is made almost equal to the longitudinal direction (the axial direction of the shield electric cable 10 in the FIG. 4) of the joint portion 22 being in contact with the rectangular exposed portion 15. In this state, a current is caused to flow across the electrodes 30 and 31 to supply a power.

With this power supply, at the portion where the electrodes 30 and 31 are brought into contact with, the joint portion 22 and the exposed portion 15 of the braided wire 13 are melted.

With this melting, the joint portion 22 and the exposed portion 15 of the braided wire 13 of the shield electric cable 10 are metal-welded to each other.

In this metal welding, metals are melted to be joined to each other. For this reason, in the metal welding, unlike mechanical joint which easily causes imperfect welding, the shield terminal joint portion 40 for strongly joining the joint portion 22 of the shield terminal 20 and the exposed portion 15 of the braided wire 13 of the shield electric cable 10 to each other is formed. This joint is improved in reliability.

Since the resistance welding using the parallel electrode scheme is applied, the welding for a small space can be easily and reliably performed.

Upon completion of the resistance welding, the electrodes 30 and 31 are separated from the shield electric cable 10.

Then, the terminal metal fitting 50 is connected to the cable core 11 of the shield electric cable 10 by caulking.

Figure 6:
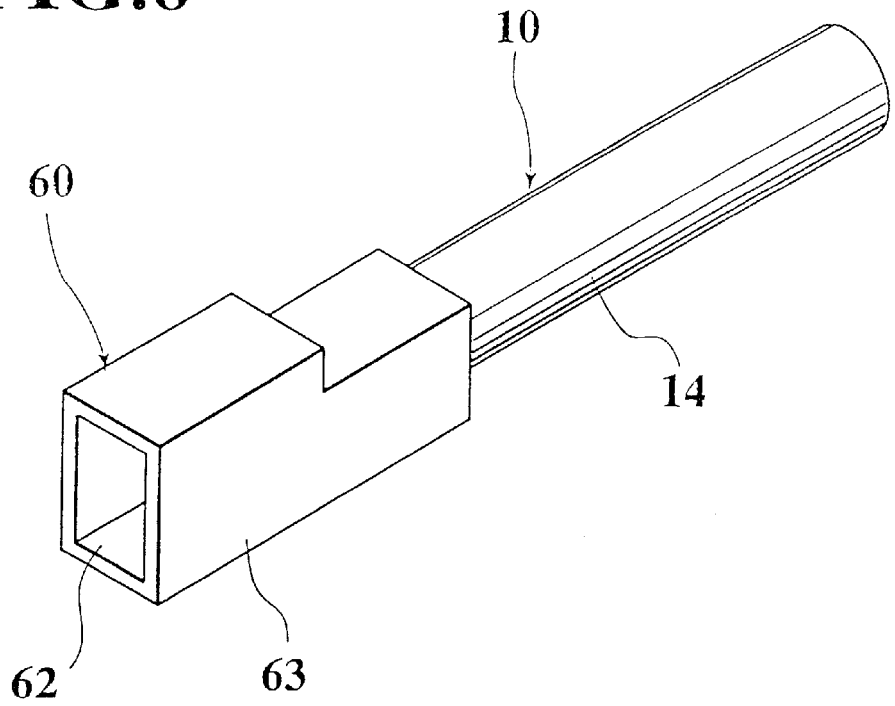
FIG. 6 is a perspective view showing a state wherein a connector housing and a shield electric cable are incorporated in the embodiment of the present invention.
Figure 7:
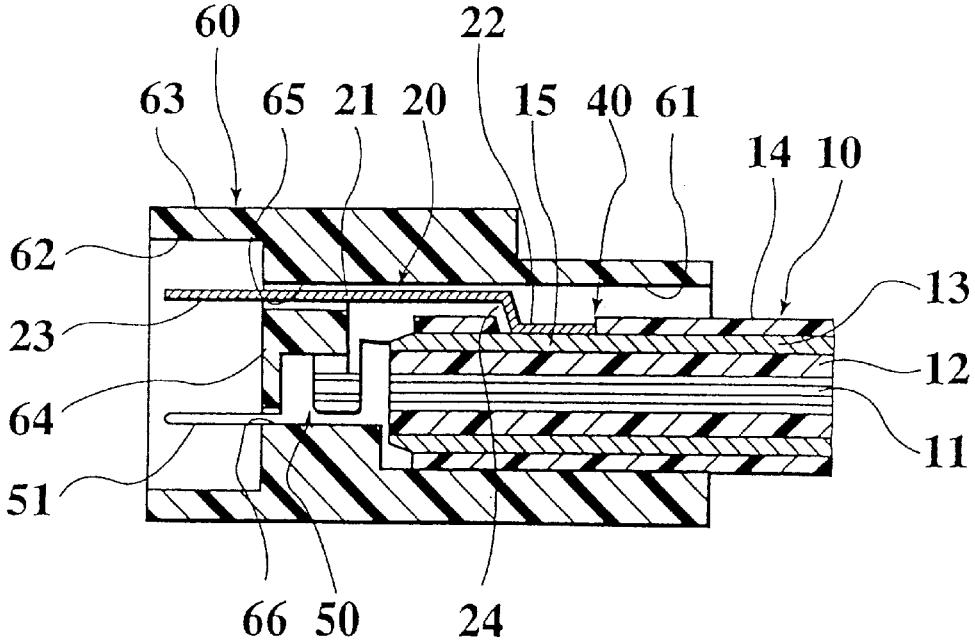
FIG. 7 is a sectional view showing a state wherein the connector housing and the shield electric cable are incorporated in the embodiment of the present invention.

As shown in FIGS. 6 and 7, the ground terminal portion 23 of the shield terminal 20 and a contact portion 51 of the terminal metal fitting 50 are accommodated in the connector housing 60.

Here, openings are formed in the front and rear ends of the connector housing 60. The rear end has an insertion opening 61 for the shield electric cable 10, and the front end has a hood portion 63 in which a terminal insertion opening 62 for an another terminal to be connected is formed.

Further, a partition 64 is formed inside the connector housing 60, and the upper portion of the partition 64 serves as a through hole 65 for the ground terminal portion 23 of the shield terminal 20, and the lower portion serves as a terminal through hole 66 of a terminal metal fitting 50.

Therefore, when the shield electric cable 10 is inserted from the insertion opening 61 of the connector housing 60, the ground terminal portion 23 of the shield terminal 20 is inserted through the through hole 65. At the same time, the contact portion 51 of the terminal metal fitting 50 is inserted through the terminal through hole 66.

In this manner, the connector housing 60 is connected to the terminal of the shield electric cable 10, and the terminal is processed, thereby completing the connection process of the shield electric cable 10.

This embodiment exemplifies the case wherein the shield terminal 20 is joined to the terminal end of the shield electric cable 10. However, depending on needs, the exposed portion 15 obtained by exposing the braided wire 13 of the shield electric cable 10 may be formed at the intermediate portion of the shield electric cable 10, and the shield terminal 20 may be joined to this exposed portion.

In this embodiment, the insulating outer jacket 14 for forming the exposed portion 15 is formed by cutting off in a rectangular shape at a position near the top portion of the insulating outer jacket 14. However, the area and the shape of the cut portion may be appropriately determined without degrading the reliability of welding, depending on the relative size of the joint portion 22 of the shield terminal 20 connected to the exposed portion 15 formed by cutting off and in consideration of the sizes or the like of the electrodes 30 and 31 used in the resistance welding. For example, as the shapes of the exposed portion 15 and the joint portion 22, the corner portions may be rounded. If the connection depends on only welding, it is sufficient that the lengths of the exposed portion 15 and the joint portion 22 in the circumference directions may be considerably shorter than the length of a half of the circumference of the insulating outer jacket 14 of the shield electric cable 10. In order to use the round shape of the arc of the section of the insulating outer jacket 14 of the shield electric cable 10 in positioning or the like, the lengths may be equal to or longer than the half of the circumference.

In the resistance welding using the parallel electrode scheme according to this embodiment, the arrangement direction of the two electrodes 30 and 31 is made almost equal to the longitudinal direction (axial direction of the shield electric cable 10 as shown in FIG. 1 and FIG. 4) of the joint portion 22 being in contact with the rectangular exposed portion 15. However, the arrangement direction of the electrodes 30 and 31 can be appropriately set within a range in which the reliability of the resistance welding is not degraded with respect to the relationship between the electrodes 30 and 31 and the joint portion 22.

Further, in the resistance welding using the parallel electrode scheme according to this embodiment, the two electrodes 30 and 31 are used as a pair of electrodes. However, in order to increase welding points in number for improvement of joint strength or the like, a plurality of pairs of electrodes may be used.

What is claimed is:

1. A connection structure for a shield electric cable having a cable core, an insulating inner jacket covering the cable core, a braided wire formed around the insulating inner jacket, and an insulating outer jacket formed around the braided wire so as to cover the cable core, the insulating inner jacket, and the braided wire, comprising:

an exposed portion of the braided wire obtained by partially exposing the braided wire on the insulating outer jacket of said shield electric cable;

a shield terminal connected to said exposed portion at said exposed portion; and a shield terminal joint portion connecting said shield terminal to said exposed portion at said exposed portion of the braided wire, wherein said shield terminal joint portion is formed by joining said shield terminal to said exposed portion with resistance welding, and said shield electric cable and said shield terminal are connected to each other with said shield terminal joint portion.

2. A connection structure for a shield electric cable according to claim 1, wherein said shield terminal has a joint portion to be joined to said exposed portion, a ground terminal portion to be grounded, and a step portion connecting said joint portion and said ground terminal portion such that said ground terminal portion is located to be spaced apart from the cable core of said shield electric cable in a state wherein said shield electric cable and said shield terminal are joined to each other.

3. A connection structure for a shield electric cable according to claim 1, wherein a terminal metal fitting is connected to said cable core, and an end portion of said shield electric cable on the connection side to which said shield terminal and said terminal metal fitting are connected is accommodated in a connector housing.

4. A connection structure for a shield electric cable according claim 1, wherein said exposed portion has a shape having a longitudinal direction in the axial direction of said shield electric cable.

5. A method of processing a shield electric cable having a cable core, an insulating inner jacket covering the cable core, a braided wire formed around the insulating inner jacket, and an insulating outer jacket, formed around the braided wire so as to cover the cable core, the insulating inner jacket, and the braided wire, comprising the steps of:

preparing said shield electric cable;

preparing a shield terminal;

partially removing the insulating outer jacket of said shield electric cable to partially expose the braided wire and to form an exposed portion; and bringing said shield terminal into contact with said exposed portion to weld said shield terminal to said exposed portion by use of resistance welding, wherein, with said resistance welding, said shield electric cable and said shield terminal are connected to each other.

6. A method of processing a shield electric cable according to claim 5, wherein said resistance welding is performed by a parallel electrode scheme such that a pair of electrodes are brought into contact with the contact portion between said shield terminal and said exposed portion to supply power to said pair of electrodes.

7. A method of processing a shield electric cable according to claim 5, wherein said pair of electrodes are arranged parallel to the axial direction of said shield electric cable.

* * * * *

UNITED STATES PATENT AND TRADEMARK OFFICE

CERTIFICATE OF CORRECTION

PATENT NO. : 5,967,855
DATED : October 19, 1999
INVENTORS : Asakura et al.

It is certified that error appears in the above-identified patent and that said Letters Patent is hereby corrected as shown below:

Claim 4, column 8, line 29, after "according", insert –to–.

Signed and Sealed this

Twentieth Day of February, 2001

*Attest:*

Nicholas P. Godici

NICHOLAS P. GODICI

*Attesting Officer*

*Acting Director of the United States Patent and Trademark Office*